US005795275A

United States Patent [19]

Van Der Hoeven et al.

[11] Patent Number: 5,795,275

[45] Date of Patent: Aug. 18, 1998

[54] EXERCISE APPARATUS

[76] Inventors: Martin A. Van Der Hoeven, 3636 Carlsbad Blvd., Carlsbad, Calif. 92008; Jaeson Cayne, 2917 Managua Pl., Carlsbad, Calif. 92056; Thomas J. Ryan, 13605 Pine Neeles Dr., Del Mar, Calif. 92014

[21] Appl. No.: 729,078

[22] Filed: Oct. 10, 1996

[51] Int. Cl.[6] ..... A63B 21/02

[52] U.S. Cl. ..... 482/122; 482/121; 482/126

[58] Field of Search ..... 482/121, 122, 482/126, 128

[56] References Cited

U.S. PATENT DOCUMENTS

| | | |
|---|---|---|
| 1,609,659 | 12/1926 | Panis . |
| 2,223,309 | 11/1940 | Swanson . |
| 3,427,023 | 2/1969 | Silberman . |
| 3,447,415 | 6/1969 | Kime . |
| 3,558,130 | 1/1971 | Anderson . |
| 3,633,908 | 1/1972 | Krauth . |
| 3,738,651 | 6/1973 | Norman et al. . |
| 4,076,237 | 2/1978 | Dussia . |
| 4,290,597 | 9/1981 | Schleffendorf . |
| 4,466,613 | 8/1984 | Reese . |
| 4,517,966 | 5/1985 | von Othegraven . |
| 4,616,825 | 10/1986 | Anderson . |
| 4,632,393 | 12/1986 | Van Noord . |
| 4,678,181 | 7/1987 | Ditsch et al. . |
| 4,757,993 | 7/1988 | Rake . |
| 4,775,148 | 10/1988 | McLaughlin . |
| 4,848,740 | 7/1989 | VanDerHoeven . |
| 4,863,162 | 9/1989 | Neckamm et al. . |
| 4,966,363 | 10/1990 | van der Hoeven . |
| 5,005,832 | 4/1991 | Van Der Hoeven . |
| 5,085,429 | 2/1992 | Van Der Hoeven . |
| 5,094,450 | 3/1992 | Stearns . |
| 5,102,125 | 4/1992 | Van Der Hoeven . |
| 5,160,304 | 11/1992 | Van Der Hoeven . |
| 5,230,683 | 7/1993 | Van Der Hoeven . |
| 5,441,473 | 8/1995 | Safani et al. . |
| 5,492,520 | 2/1996 | Brown . |

FOREIGN PATENT DOCUMENTS

| | | | |
|---|---|---|---|
| 1460811 | 10/1977 | France | 482/128 |
| 599789 | 5/1978 | Switzerland . | |

*Primary Examiner*—Lynne A. Reichard
*Attorney, Agent, or Firm*—Christie, Parker & Hale, LLP

[57] ABSTRACT

An exercise apparatus for strengthening the abdominal muscles, upper legs, and back comprises a large engagement surface and a pair of handles angled away from a body to provide stability. The portable exercise apparatus utilizes a slide member slidably positioned in a channel of a yoke and biased in one direction by an elastic cord. A base, which is positioned at one end of the slide, is placed against the abdomen or the buttocks while the user pulls the yoke towards the abdomen or buttocks by grasping the handles mounted astride the slide. The user contracts the abdominal or buttocks muscles while pulling the hands toward the abdomen or buttocks to hold the apparatus stationary. Strengthening of the abdominal or buttocks muscles is achieved by moving the abdomen or buttocks against the biasing force of the elastic cord.

16 Claims, 6 Drawing Sheets

88
91
83
40
47
93
24
70
28
78
22
64
Y
56
54
X
26
β
52
58
Z
56
49
30
66
96
98
98
34
96
32
36
96

Y
90
88
91
92
92
40
93
83
42
72
22
68
80
72
26
82
47
24
δ
84
42
70
86
48
50
86
46
44
84
α'
64
X
56
72
60
28
56
62
66
52
49
72
34
94
94

Y
X
88
91
83
92
93
20
22
26
24
56
54
66
α'
X
64
52
58
Y
α
56
34
94
94

EXERCISE APPARATUS

FIELD OF THE INVENTION

This invention relates to exercise apparatuses and activities for increasing muscle tone, size, and definition. More specifically, it relates to isometric exercise methods and devices for developing abdominal and gluteus muscles.

BACKGROUND OF THE INVENTION

The abdominal and gluteus muscles are difficult to isolate and strengthen. Generally, many hours and years of disciplined exercise are necessary to produce the desired result in the abdominal muscles. The prior art discloses three categories of muscular development methods and apparatuses as follows:

full range of motion;

limited range of motion; and compression devices.

The full range of motion devices are illustrated in U.S. Pat. Nos. 4,290,597; 3,558,130; and 4,616,825. Each of these devices relates to a modification of the well-known sit-up exercises. Though desired results can be obtained with these devices, they suffer from two major drawbacks. First, many muscle groups are indiscriminately exercised in addition to exercising the targeted abdominal or gluteus muscles. This results in slow development of the targeted muscles. Second, the flexing of the lumbar and thoracic portions of the spine which occur over a significant range of motion may exacerbate previous lower back and other injuries.

Limited range of motion inventions are typified by Schleffendorf, U.S. Pat. No. 4,290,597, generally involving an exercise called an "abdominal crunch." While such inventions have some success in isolating the abdominal muscles, the positioning of the operator is such that maximal benefit to the operator is not achieved, and the spine is still curved during the exercise.

More recently developed devices such as U.S. Pat. No. 5,160,304 to Van Der Hoeven, which is, in its entirety, hereby incorporated herein by reference, and which discloses a related device avoid the above disadvantages, but the arms tend to contact the torso causing the arms to flare outwardly interfering with the exercise. This creates some instability while using the device to exercise. Further, a typical contact area between the user and one of these devices is relatively small, and therefore, causes a high build up of pressure at the contact area and hinders stability.

Thus, avoiding or reducing the flexing of the spine while effectively isolating the abdominal or gluteus muscles with a stable exercise apparatus is desirable to enhance the benefit gained from exercise and avoid injury or reinjury during exercise. To further increase the benefit gained and increase stability, it is also desirable to increase the contact area between the device and the user thereby reducing the pressure at the contact area.

SUMMARY OF THE INVENTION

There is, therefore, provided in one embodiment of this invention a novel exercise apparatus comprising a body having a channel extending therethrough with a slide member positioned in the channel and being slidable therein in a reciprocating manner. The slide member has a user engagement end extending from the channel for engaging a targeted muscle area of the user. A resilient member engages the body and the slide to bias the slide in one direction, and first and second handles are attached to the body at opposing locations, and the handles extend away from the body at first and second acute angles respectively.

In a preferred embodiment of the invention the magnitudes of the first and second angles are equal. The body is generally rectangular and comprises two opposing sides. The channel is defined by the body and positioned between the two sides with the first handle attached to one side and the second handle attached to the other side. The exercise apparatus further comprises a base attached to the user engagement end of the slide. The base has a large engagement surface to add stability to the exercise device.

Preferably, the handles make an angle of 25 degrees within the X axis as they extend away from the engagement end of the slide, and the handles preferably make an angle of 25 degrees with the X axis as they extend toward the top of the body. The handles add further stability to the device by extending at least as high as the top of the body and preferably above the top of the body. The handles are also positioned in the body to be near the center of the slide during exercising. Wrist channels extend from the handles toward the user engagement end at an angle of approximately 12 degrees with a wide axis. For advanced users, a second resilient member may be added to the exercise apparatus. The resilient members are held by the resilient member engagement end of the slide which includes a retaining ring and a retaining tab extending transverse to the retaining ring. The body, handles, and slide all combine to form stacking surfaces for receiving similarly configured exercise apparatuses in a stacked arrangement.

DETAILED DESCRIPTION

Figure 6:
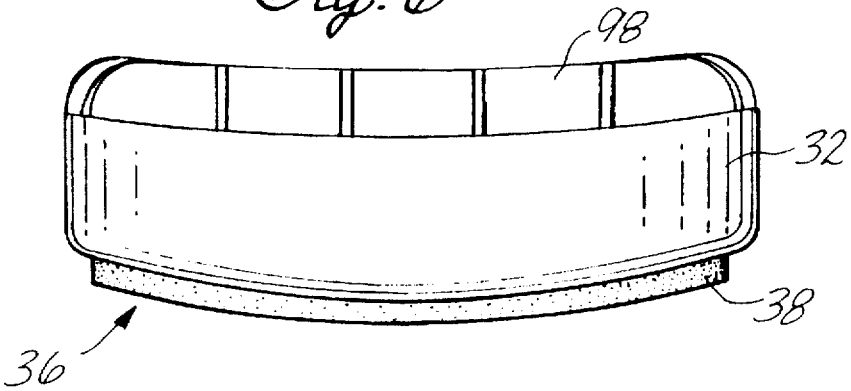
FIG. 6 is a side view of a base of the exercise apparatus of FIG. 1.

FIGS. 1 through 5, show a light weight portable exercise apparatus, generally designated 20, which may be used in a variety of positions to exercise different muscles. The exercise apparatus comprises a generally rectangular body 22 forming a yoke that connects a pair of handles 24, 26. The handles are positioned on opposing locations of the yoke and extend away from the yoke at angles with the X axis and Y axis. A slide member 30 is slidably held in a channel, generally designated 28, extending through the center of the yoke in a direction perpendicular to the X axis. The slide reciprocates back and forth in a longitudinal direction in the channel. A base 32 is detachably connected at a user engagement end 34 of the slide. The user engagement end extends out of the channel to engage a targeted muscle area, and the base has a user engagement surface, generally designated 36, which is sized to provide a large contact area with a user's body to increase stability and reduce the pressure in the contact area. The engagement surface is also provided with a foam pad 38 (FIG. 6) to cushion the contact area.

Figure 1:
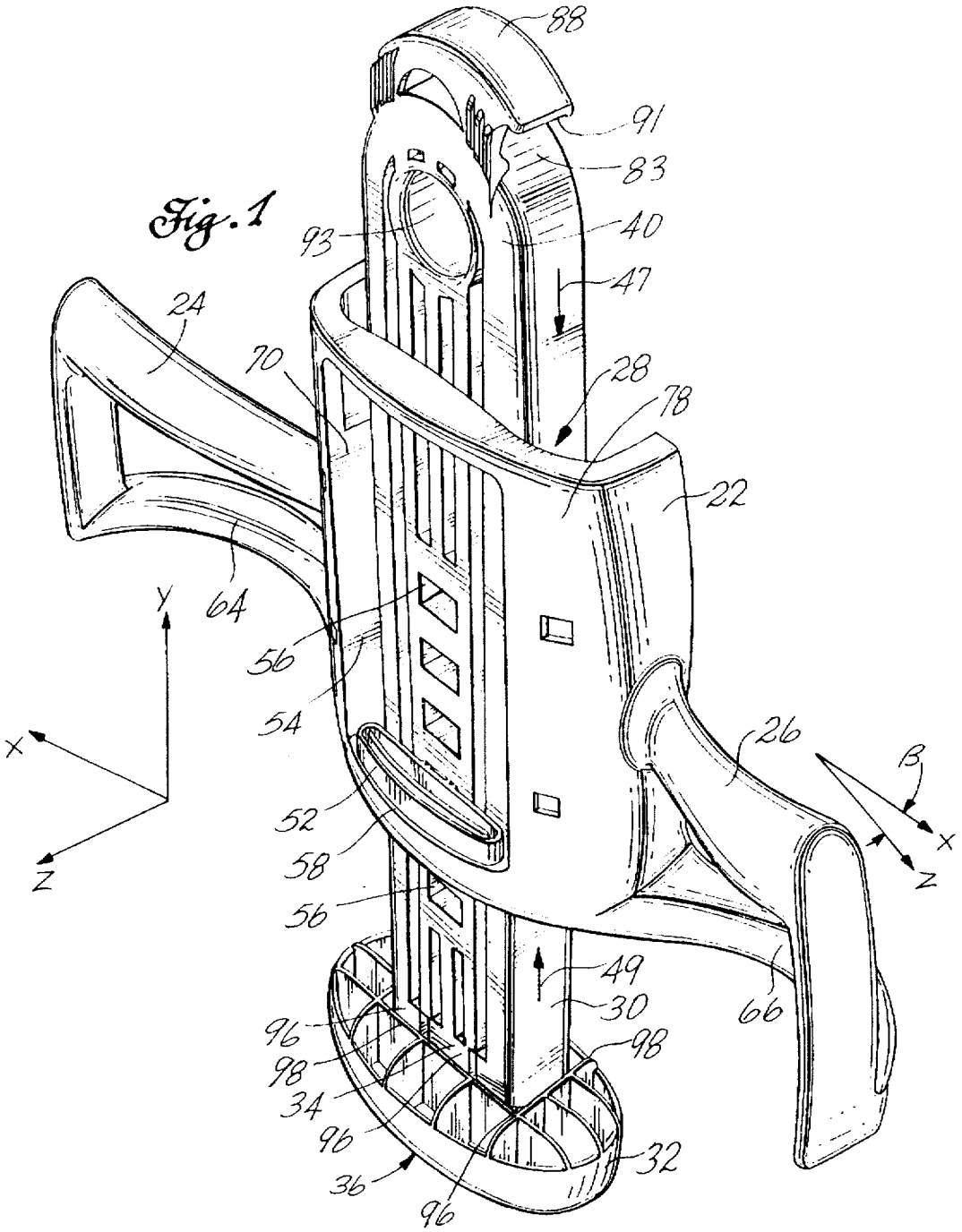
FIG. 1 is a perspective view of an exercise apparatus according to the present invention.
Figure 2:
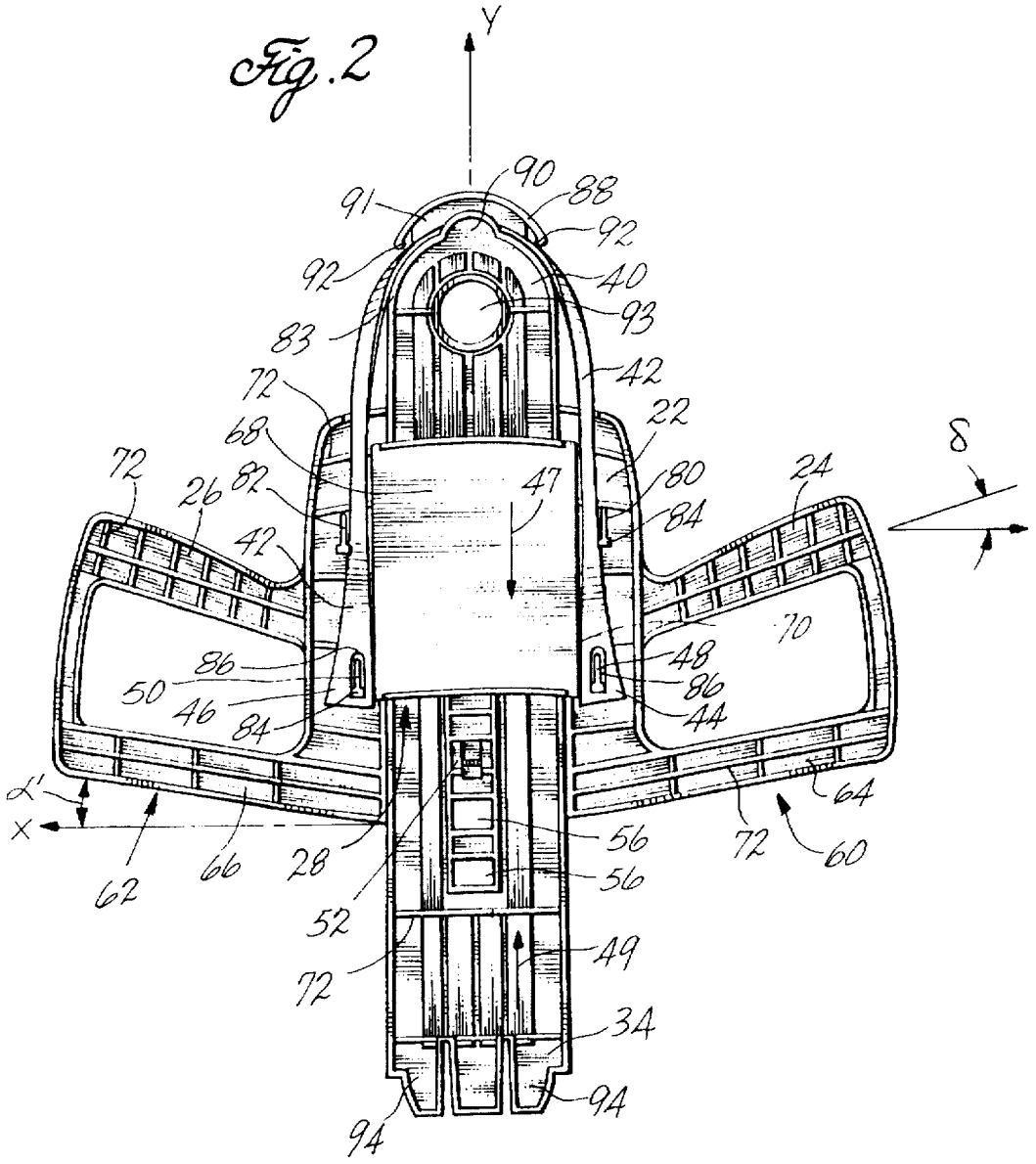
FIG. 2 is a bottom view of the exercise apparatus of FIG. 1.
Figure 3:
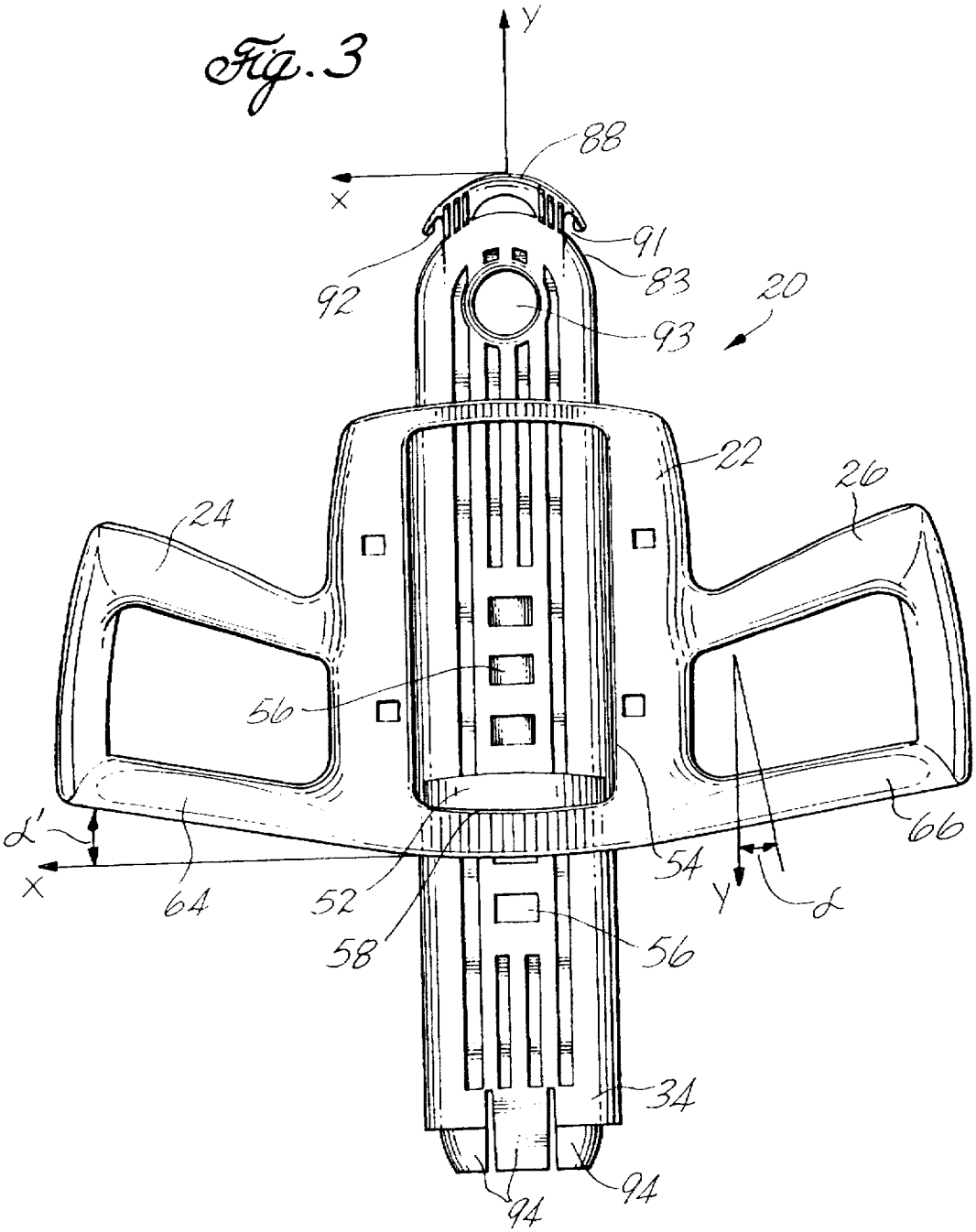
FIG. 3 is a top view of the apparatus of FIG. 1.

Referring specifically to FIG. 2, the opposite end 40 of the slide, which is a resilient member engagement end, engages a median portion of a resilient member, preferably an elastic cord 42. The extremities 44, 46 of the cord each have an aperture 86 attached to one of a pair of anchoring posts 48, 50 projecting from the undersurface of the yoke on opposite sides of the channel 28 and slide 30, and the middle of the cord wraps around the resilient member engagement end 40. Thus, the resilient member engages both the body and the slide to bias the slide in a direction toward the user, as illustrated by arrow 47. As the slide progresses into the channel away from the user, as illustrated by arrow 49, it stretches the elastic cord which resiliently opposes the movement of the slide into the channel. An adjustment pin 52 best shown in FIGS. 1 and 3 can be inserted through a wide window 54 in the upper surface of the yoke into one of a plurality of apertures 56 located along the length of the slide. The widths of the head of the adjustment pin and the window area are approximately three (3) inches which gives a large contact area with an inner wall 58 of the body, and thus, it adds stability to the apparatus. Placing the pin in an aperture pretensions the resilient member, and thus, the location of the aperture into which the pin is inserted determines the force necessary to initially move the member inwardly into the channel.

In operation, a user grasps the handles and places the base against, for example, the abdomen. The user then holds the yoke stationary while flexing the abdomen, thereby loading the cord and exercising the abdominal muscles. The amount of penetration of the slide into the channel from the starting position set by the pin pressing against the inner wall 58 of the window is limited by the length of the window. It may also be limited by inserting a second pin through the window into another one of the apertures.

The entire yoke and handle assembly is formed as an integral piece of plastic including a bottom plate 68 and side walls 70 forming the channel to engage and guide the movement of the slide. Though the body is preferably rectangular, the body could have any other shape such as circular. The rectangular body comprises two opposing sides, and the channel is located between the sides. Each handle is attached to only one side and is opposite the other handle. Reinforcing ribs 72 are utilized through out the body and the handles to ensure adequate strength and rigidity. Each of the two handles 24, 26 marks the end of wrist receiving areas, generally designated 60, 62 which are bridged by arcuate wrist support strips 64, 66 forming convenient wrist supports for the comfort and safety of the user. The wrist strips also add strength and stability to the apparatus. The wrist receiving areas extend away from the body at angles $\alpha$ with the Y axis. The angle is preferably in the range of approximately eight (8) degrees to approximately eighteen (18) degrees with twelve (12) degrees being most preferred. The angle $\alpha'$ between the strips and the X axis is preferably ten (10) degrees, but it may range from approximately five (5) degrees to approximately fifteen (15) degrees.

Further, the wrist receiving areas have a volumetric center which is at the same plane or level as the slide. This is a significant improvement because the volumetric center of such areas in prior art devices is below the level of the slides. Having the volumetric center on the same level as the slide permits the user to exert more force toward his body and less force upwardly which leads to increased stability.

Figure 4:
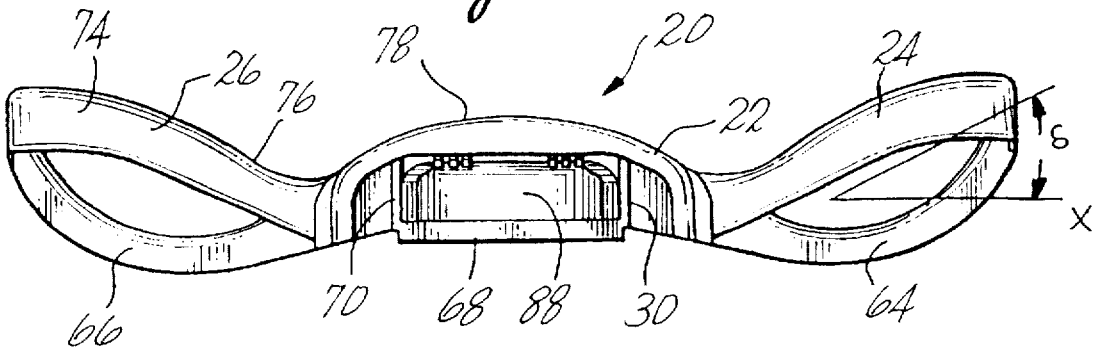
FIG. 4 is an end view of the apparatus of FIG. 1.

The first handle extends away from the body at a first angle with the X axis that is defined by the acute angle $\beta$ between the X axis and the handle as it extends away from the user engagement end, and by the acute angle $\delta$ between the X axis and the handle as it extends toward the top of the body. The angle $\beta$ has a preferred range between approximately fifteen (15) degrees and approximately thirty (30) degrees with twenty-five (25) degrees the most preferred. The angle $\delta$ has a preferred range between approximately twenty (20) degrees and approximately thirty-five (35) degrees with twenty-five (25) degrees the most preferred. The second handle extends from the X axis at a second angle which is preferably equal in magnitude to the first angle. The magnitudes and directions of the angles are selected so that the user's arms are placed in a natural position while exercising to increase stability. With the handles angled, the user's elbows rest comfortably in a natural position beside the torso instead of being pushed into the torso as is the case when the handles are at ninety degrees with the X and Y axes. To add further stability, the handles extend at least as high as the top 78 of the body, as shown in FIG. 4, the handles preferably extend above the top of the body. Stability is increased even further by positioning the handles on the body so that they will be near the longitudinal center of the slide while the user exercises.

Referring again to FIG. 4, the handles also have a curved contour designed to fit the contour of a user's hand. In the preferred embodiment shown, the curve has a convex region 74 spaced farther away from the body and a concave region 76 adjacent to the handle. Thus, the contour is a single inverting curve in that it changes from concave to convex one time. The curve could be double or triple inverting also, and circumferential grooves could be made around the perimeter of the handle to receive the user's fingers. These features combine to provide an exercise apparatus which may be used with less unnecessary discomfort over a longer period of time.

The bottom side of the exercise apparatus is provided with a second set of anchoring posts 80, 82, (FIG. 2) so that additional resilient members can be added. The second set of anchoring posts is preferably angled at five (5) degrees with the Y axis so that the resilient member wraps smoothly around the resilient member engagement surface 83 of the slide. Both sets of anchoring posts preferably have an enlarged portion 84 at an end opposite the resilient member engagement end of the slide to securely hold the cords in place once the cord aperture 86 is placed over the post.

The slide is generally rectangular, has reinforcing ribs for strength, and slidably fits into the generally rectangular channel of the body. At the resilient member engagement end, the slide has an arcuate surface 83 of constant arc to receive the midsection of the resilient member. A retaining ring 88, having an arc complimentary to the arcuate surface, extends from the resilient member engagement end and forms a groove 91 to hold the resilient member in place in conjunction with a retaining tab 90. The retaining ring has protrusions 92 at both ends which also help to hold the resilient members in place and provides a large enough groove for two cords. The retaining tab extends transverse to the retaining ring and stays in the plane of the surface of the slide. This greatly simplifies removal and attachment of the resilient members. A hanging aperture 93 for hanging the device is also provided at this end to conveniently store the device. Further, the body, handles, and slide combine to form upper and lower stacking surfaces, so that many exercise apparatuses can be stored in neat piles.

At the user engagement end, the slide has a means for detachably connecting to the base 32. The base connection means is preferably detachable and comprises three prongs 94 which fit snugly into three apertures 96 formed by the reinforcing ribs 98 of the base. Other possible means are clips and threaded fasteners for example.

The base 32 at the proximal end (relative to the user) of the slide is designed to bear against the abdomen of the user. Therefore, to increase stability, reduce the pressure in the contact area between the user and the base, and spread the overall force, a large user engagement surface larger than approximately eight (8) square inches is preferred. In the embodiment shown in FIGS. 5 and 6, the base is oval with a slightly curved user engagement surface 36 to engage the user. The curvature is approximately nine (9) inches in radius. The over all dimensions of the oval are approximately six (6) inches by three (3) inches, and the area of the engagement surface defined by the foam pad 38 is greater than approximately ten (10) square inches.

Figure 7:
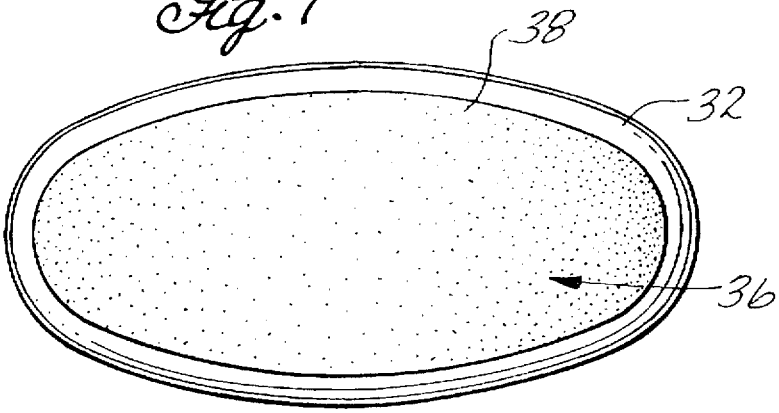
FIG. 7 is a top view of the base of FIG. 6.
Figure 5:
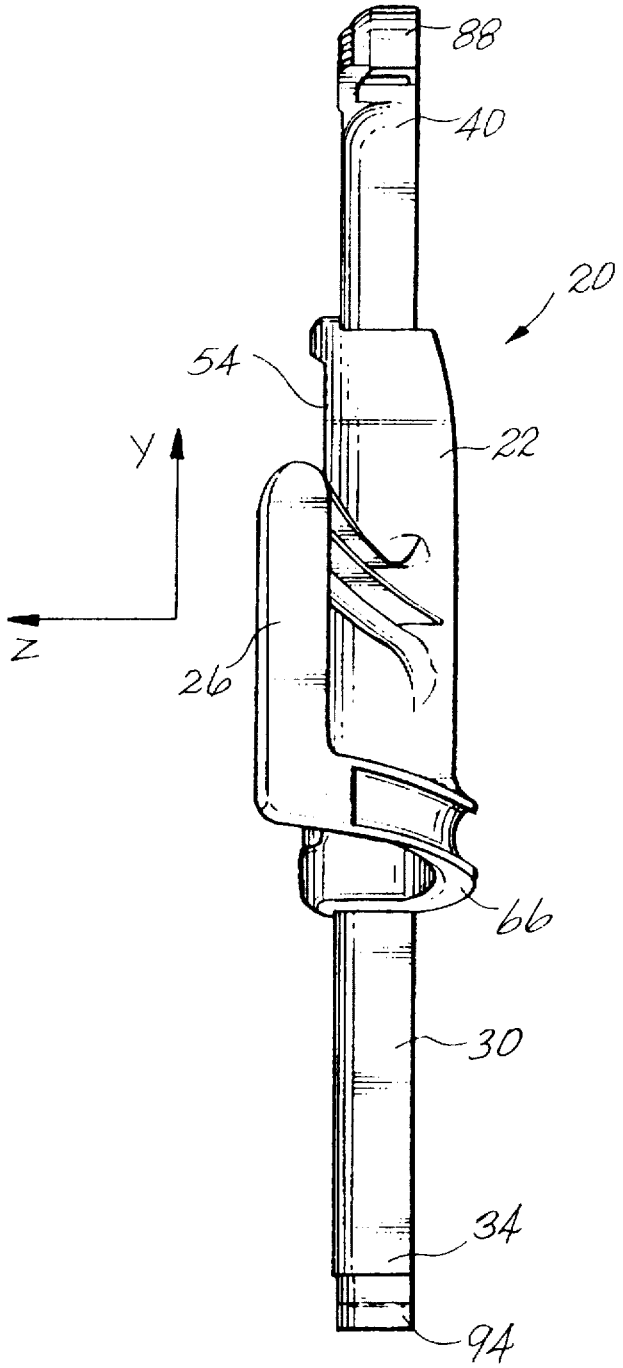
FIG. 5 is a side view of the apparatus of FIG. 1.
Figure 8:
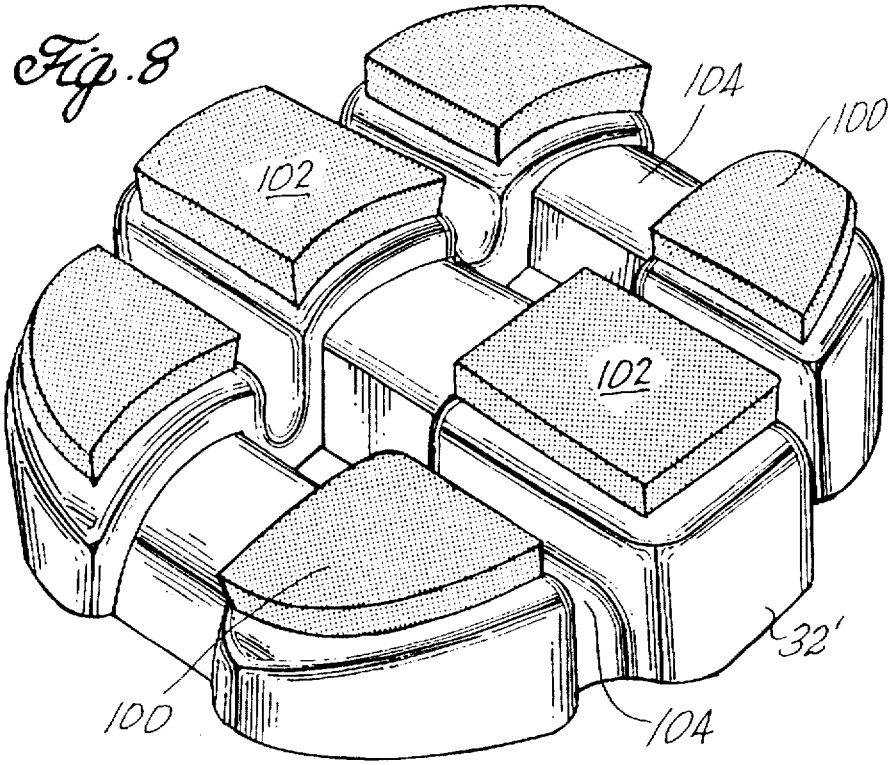
FIG. 8 is a perspective view of an alternate embodiment of a base for the exercise apparatus of FIG. 1.

An alternate base 32' is shown in FIGS. 7 and 8 which is more completely described in Design U.S. application Ser. No. 29/057,810, U.S. application Ser. No. 08/597,452, and a continuation application from the latter which are hereby incorporated herein by reference. The engagement surface of this embodiment is ribbed. There are four triangles 100 at the corners with two rectangles 102 between the triangles on the long sides of the engagement surface which is again gradually curved. The triangles and rectangles are separated by grooves 104 that intersect at ninety (90) degrees. This embodiment has a user engagement area greater than approximately nine (9) square inches and spreads the force of the exercise over a larger area.

Figure 9:
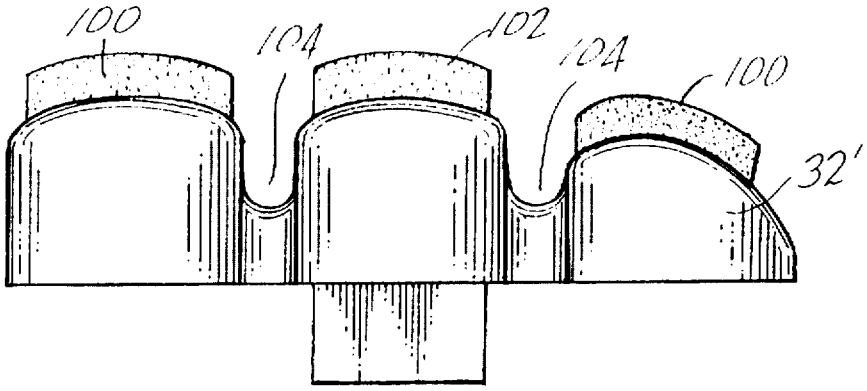
FIG. 9 is a side view of the base of FIG. 8.
Figure 10:
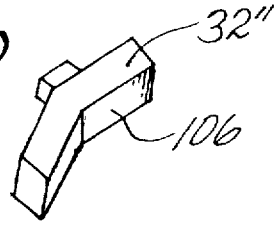
FIG. 10 is a perspective view of another alternate embodiment of a base for the exercise apparatus of FIG. 1.

Still another alternate base 32", shown in FIG. 9, is provided with an angular bearing surface 106 with an angle between approximately 150–160 degrees. This alternate base is particularly adapted for contact with the hips and buttocks of the user during other types of muscle development exercises.

A first use of the exercise apparatus is for developing the abdominal muscles. A user assumes a seated position with forelegs substantially vertical. Keeping the spine in the erect position, the user holds the apparatus by the pair of handles with the palms up, pulling the exerciser toward the abdomen, until the base bears against the abdominal area. The arms are held in a fixed position while the abdominal muscles are flexed causing the slide to reciprocally and resiliently move within the immobilized yoke.

A second use of the apparatus is for developing the gluteus and back muscles. The slide is fitted with the angled base, and the user holds the apparatus behind him by the handles with his palms up and back erect. The bearing surface of the base is brought against the left buttock, and the yoke is maintained in a substantially horizontal position. Holding the apparatus immobile, the user flexes his gluteus muscles to cause the slide to reciprocally and resiliently move within the channel. Contractions and relaxation of the gluteus muscles can be effected by circular movements of the user's leg. A similar exercise can be practiced by positioning the angled base against the right buttock after the base is rotated 180 degrees.

Thus, a portable light weight exercise apparatus is disclosed which utilizes angled and contoured handles, increased adjustment pin size, and increased user engagement area to provide a more stable exercise apparatus that can fit into a common brief. While preferred embodiments and particular applications of this invention have been shown and described, it would be apparent to those skilled in the art that many more modifications are possible without departing from the inventive concepts herein. It is, therefore, to be understood that, within the scope of the appended claims, this invention may be practiced otherwise than as specifically described.

What is claimed is:

1. An exercise apparatus comprising:

a body having a channel extending therethrough;

a slide member positioned in the channel and being slidable therein in a reciprocating manner and having a user engagement and extending from the channel having means for engaging a targeted muscle area of a user;

a resilient member engaging the body and the slide to bias the slide in one direction; and first and second handles attached to the body at opposing locations and extending away from the body at first and second acute angles each extending in a different direction perpendicular to a longitudinal axis of the body respectively, wherein the first angle is about 25 degrees.

2. The exercise apparatus according to claim 1 wherein the first and second angles are equal in magnitude.

3. The exercise apparatus according to claim 1 wherein the body is generally rectangular and comprises two opposing sides, the channel is defined by the body and positioned between the two sides, the first handle is attached to one of the sides, and the second handle is attached to the other side.

4. The exercise apparatus according to claim 1 further comprising a second resilient member, and the resilient members comprise elastic cords.

5. The exercise apparatus according to claim 1 wherein the engaging means is a base attached to the user engagement end and having a large engagement surface.

6. The exercise apparatus according to claim 5 wherein the engagement surface is oval and as an area greater than approximately 10 square inches.

7. The exercise apparatus according to claim 5 wherein the engagement surface is ribbed and has an area greater than approximately 9 square inches.

8. The exercise apparatus according to claim 1 wherein the second angle is in the range from about 20 to about 35 degrees.

9. The exercise apparatus according to claim 8 wherein the second angle is 25 degrees.

10. The exercise apparatus according to claim 1 further comprising at least one stacking surface for receiving in a stacked arrangement a similarly configured exercise apparatus.

11. The exercise apparatus according to claim 1 wherein the slide comprises a hanging aperture for storage.

12. The exercise apparatus according to claim 1 wherein at least one handle has a curved contour for fitting the contour of a users hand, and the contour comprises a single inverting curve.

13. A portable, light weight, and compact exercise apparatus for exercising muscles of a user comprising:

a body having a channel extending therethrough and a top;

a slide member positioned in the channel and being slidable therein in a reciprocating manner and having a user engagement end extending from the channel for engaging a targeted muscle area of the user;

a resilient member engaging the body and the slide to bias the slide in one direction; and first and second handles attached to the body at opposing locations and extending away from the body at a first angle β and a second angle δ wherein β and δ are each 25 degrees extending in different directions which are perpendicular to a horizontal axis of the body.

14. The exercise apparatus according to claim 13 wherein the handles are positioned on the body to be near the center of the slide during exercising.

15. A portable, light weight, and compact exercise apparatus for exercising muscles of a user comprising:

a body having a channel extending therethrough and a top;

a slide member positioned in the channel and being slidable therein in a reciprocating manner and having an end extending from the channel in a direction of a targeted muscle area of the user;

a resilient member engaging the body and the slide to bias the slide in one direction;

first and second handles attached to the body at opposing locations and extending away from the body such that grips on the handles are positioned outside of a plane formed by a lateral and a longitudinal axis of the body;

a base attached to the end of the slide member and having a large engagement surface larger than approximately eight (8) square inches; and two wrist channels extending from the handles toward the user engagement end at an angle of approximately 12 degrees with a longitudinal axis of the body.

16. The exercise apparatus according to claim 15 wherein the slide comprises a resilient member engagement end including an arcuate surface, a retaining ring with an arc complimentary to the arcuate surface, and a retaining tab extending transverse to the retaining ring.

* * * * *